US008800978B2

(12) United States Patent
Tarazona De La Asuncion

(10) Patent No.: US 8,800,978 B2
(45) Date of Patent: Aug. 12, 2014

(54) SYSTEM FOR MANUFACTURING PRESSURE OR IMPACT RECEIVING BODIES DESIGNED TO ACHIEVE DIRECTABLE CUSHIONING

(75) Inventor: Ramiro Tarazona De La Asuncion, Tarazona (ES)

(73) Assignee: Taexpa, S.L., Tarazona (ES)

( * ) Notice: Subject to any disclaimer, the term of this patent is extended or adjusted under 35 U.S.C. 154(b) by 211 days.

(21) Appl. No.: 12/742,111

(22) PCT Filed: Nov. 12, 2008

(86) PCT No.: PCT/ES2008/000702

§ 371 (c)(1), (2), (4) Date: May 10, 2010

(87) PCT Pub. No.: WO2009/063109

PCT Pub. Date: May 22, 2009

(65) Prior Publication Data

US 2010/0264571 A1 Oct. 21, 2010

(30) Foreign Application Priority Data

Nov. 15, 2007 (ES) ..... 200703027
Jun. 30, 2008 (ES) ..... 200801947

(51) Int. Cl.

| | |
|---|---|
| ***A47C 17/00*** | (2006.01) |
| ***A47C 27/20*** | (2006.01) |
| ***A47G 9/10*** | (2006.01) |
| ***A47C 27/14*** | (2006.01) |
| ***A43B 13/18*** | (2006.01) |
| ***A47C 27/15*** | (2006.01) |
| ***A42B 3/12*** | (2006.01) |

(52) U.S. Cl.

CPC ..... *A47C 27/15* (2013.01); *A47C 27/20* (2013.01); *A47G 9/10* (2013.01); *A47C 27/144* (2013.01); *A43B 13/181* (2013.01); *A42B 3/128* (2013.01)

USPC ..... 267/142; 5/727; 5/740; 5/655.9

(58) Field of Classification Search

USPC ..... 5/722, 727, 730, 740, 655.9; 267/142, 267/117, 136, 143, 146

See application file for complete search history.

(56) References Cited

U.S. PATENT DOCUMENTS 3,319,274 A * 5/1967 Upton ..... 5/701
4,383,342 A 5/1983 Forster (Continued)

FOREIGN PATENT DOCUMENTS

DE 24 05 405 * 8/1975 ..... A47C 27/05
DE 2542178 A1 3/1977

(Continued)

OTHER PUBLICATIONS

Machine translation of DE 24 05 405.*

(Continued)

*Primary Examiner* — Bradley King
*Assistant Examiner* — Nicholas J Lane
(74) *Attorney, Agent, or Firm* — Gifford, Krass, Sprinkle, Anderson & Citkowski, P.C.

(57) ABSTRACT

The system is based on the combination of two parts (1 and 1') of differing densities with complementary tilted protuberances (2 and 2'), coupled to form a single unit. These protuberances vary in shape, length and thickness so that systems of differing rigidity can be obtained, thus achieving cushioning in virtue of the said protuberances (2 and 2'), enabling the path of the force applied to be defined, thus achieving optimum cushioning force. The system is applicable to both pressure cushioning systems (mattresses, pillows, seats, etc.) and impact cushioning systems (footwear, wheels, helmets, etc.).

8 Claims, 6 Drawing Sheets

(56) References Cited

U.S. PATENT DOCUMENTS

| | | | | |
|---|---|---|---|---|
| 4,561,195 | A | 12/1985 | Onoda et al. | |
| 4,638,577 | A | 1/1987 | Riggs | |
| 2001/0052194 | A1 | 12/2001 | Nishiwaki et al. | |
| 2005/0044635 | A1* | 3/2005 | O'Reagan | 5/736 |
| 2006/0260060 | A1* | 11/2006 | Apperson et al. | 5/691 |

FOREIGN PATENT DOCUMENTS

| | | | |
|---|---|---|---|
| DE | 4124044 | A1 | 1/1993 |
| DE | 19600435 | A1 | 7/1997 |
| DE | 29917541 | U1 | 2/2001 |
| EP | 1430814 | A1 | 6/2004 |
| EP | 1527716 | A1 | 5/2005 |
| ES | 507107 | U | 12/1981 |
| ES | 260879 | U | 4/1982 |
| GB | 2121275 | A | 12/1983 |
| GB | 2121275 | A | 12/1983 |
| GB | 2197785 | A | 6/1988 |
| GB | 2197785 | A | 6/1998 |

OTHER PUBLICATIONS

Machine Translation of DE 24 05 405 (no date).*

* cited by examiner

SYSTEM FOR MANUFACTURING PRESSURE OR IMPACT RECEIVING BODIES DESIGNED TO ACHIEVE DIRECTABLE CUSHIONING

CROSS-REFERENCE TO RELATED APPLICATIONS

This application is the U.S. national phase of PCT/ES2008/000702 filed Nov. 12, 2008, which claims priority of Spanish Patent Application No. ES 200703027 filed Nov. 15, 2007 and Spanish Patent Application No. ES 200801947 filed Jun. 30, 2008.

OBJECT OF THE INVENTION

This invention refers to a system for manufacturing pressure or impact receiving bodies designed to achieve directable cushioning, on the basis of two fundamental, complementary surfaces with an ingenious opposing arrangement, provided with series or successions of tilted protuberances which fit into each other, the two surfaces being precisely related by the interlocking of the aforementioned series of protuberances. These parts will be made of a significantly elastic material, and each part will be of a different density.

The object of the invention is to achieve a cushioning system enabling deflection of the path of the force applied due to the inclination of the protuberances, thus attaining an optimum cushioning effect, together with improved load distribution.

The system is applicable to both pressure cushioning (mattresses, pillows, seats, wheels, etc.) and impact cushioning (shoe soles and insoles, wheels, helmets, headrests, sports car bumpers, packaging, flooring, etc.).

BACKGROUND TO THE INVENTION

At present, the cushioning offered by a body, such as a mattress, a shoe sole, etc., is provided by means of pressure or impact; the impact is not deflected and the effect of the cushioning is limited, logically depending on the physical characteristics of the body in question.

There are no known cushioning systems based on the structural characteristics claimed in this Patent of Invention.

DESCRIPTION OF THE INVENTION

The cushioning system proposed herein can be considered a new concept in directable cushioning, achieved by combining the shapes and densities of at least two parts made of two different materials, or made of the same material but with a different density, an example of which could be foam rubber, moulded or cut and then joined.

The two parts or bodies are provided with a linear series of protuberances, inclined with respect to the surface from which they emerge. These parts are joined by intercalating the series of protuberances on one of the parts or bodies with the series of protuberances on the other, thus configuring one single body whose core is formed by the joined protuberances, while the outer part is configured by the visible surface of the cushioning body.

The two parts or bodies will be of a different density and they may have a third part or body intercalated between them, depending on the desired hardness and effect to be obtained.

On the basis of this system, when a force or impact is applied to the same, in accordance with the inclination of the series of protuberances, determined by their angle with respect to the surface from which they emerge, the path of the said force is cushioned and deflected due to the elastic response of the series of protuberances.

According to the desired objective, the geometry and density of each of the parts or bodies making up the cushioning system could be of one particular design or another, thus achieving systems of differing rigidity.

The system provides both pressure and impact cushioning; the former case can be applied to mattresses, seats, pillows, etc., while the latter case, i.e. impact cushioning, can be applied to shoe soles and insoles, packaging, wheels and all types of protection in general: helmets, headrests, sports car bumpers, flooring, packaging, etc.

In the case of footwear and wheels, for example, in addition to cushioning the system also favours the direction of travel.

It should also be stressed that the series of protuberances on each of the parts or bodies may all have the same inclination throughout the entire surface, or they may form groups with different inclinations, depending on the application for which the general cushioning body obtained is to be used. In the case of opposing inclinations, for a mattress for example, a dual function is achieved, both prophylactic and therapeutic, of particular interest for the treatment of spine diseases or disorders such as hernias or disc protrusions, lumbago or sciatica, as these opposing inclinations of the protuberances facilitate gentle vertebral "decompression". In this regard it should be underlined that the average person spends 6-8 hours at rest, and so the gentle but prolonged effect of the object of the invention is very effective, improving the quality of sleep.

Air chambers may also be created where the series of complementary protuberances on one part or body and the other fit into each other. These air chambers are obtained when the protuberances on the part or body made of a less dense material are shorter than the protuberances on the denser part or body, meaning the protuberances on the first body do not reach the bottom of the cavities configured between the protuberances of the second body, the air chamber thus being created as a result of the shorter length of the protuberances of the denser body.

Logically, the degree of insertion of the protuberances may vary, from 100%, in which case there would be no air chamber, to 0%, if there were no protuberances at all in the less dense body, in which case all the recesses in the denser body would be air chambers.

In any case, the greater or lesser air capacity, i.e. the greater or lesser width of the air chambers, will depend on several factors, the most relevant of these being the weight of the person.

The major advantages of these particular features include:

- Improved ventilation of the object the system is applied to, particularly relevant in the case of mattresses.
- Increased lightness of the product, as the protuberances on one of the bodies are smaller.
- Savings on production costs, as less material is required.
- Less weight, and therefore greater ease of transport.
- Better regulation of the rigidity of the resulting product, which is very important in the case of mattresses.

In order to delimit softer and more rigid areas on the surface of a body constructed in accordance with the system described in this patent, a number of longitudinal cuts could be made, precisely on the protuberances emerging from the denser of the elastic bodies making up the system, which in the case of a mattress would be the lower part of the same. The said cuts on the protuberances would be variable in depth, depending on the use to which the invention is to be put in each case.

Also, the protuberances on each of the bodies or parts making up the system could be of a different thickness and shape, i.e. those on the upper part would have a greater or lesser width or thickness with respect to the complementary or lower part, so that the rigidity of the pressure receiving body could be adapted in accordance with the areas of greater or lesser weight of the body. In the specific case of a mattress, for example, the protuberances in the head area would be thinner, due to the lesser weight of the head, resulting in a more ergonomic effect.

There could also be small split prolongations at the ends of the protuberances on one of the parts, which would favour the rotation and recuperation of the protuberances themselves. These splits would preferably be made in the protuberances in the areas bearing less pressure (the areas for the head and legs, for example, in the case of mattresses), and the corresponding recesses or protuberances would also exist in the complementary part to house the aforementioned split protuberances.

Another possible configuration would be for the combination of protuberances and recesses on the two bodies or parts to only apply to one section of a body, instead of its whole length. So, continuing with the example of the mattress, a section of mattress with the improvements described in this invention could be combined with a section of conventional mattress, the directable part, i.e. the part containing the improved system described in this invention, being used for the body area requiring treatment, e.g. the cervical or lumbar region. There is also the possibility, again for the specific case of a mattress, of prolonging this combination of protuberances and recesses on the two bodies or parts in the area supporting the head, above the support area of the mattress, thus forming a pillow integrated with the body of the mattress itself. In this case the interior configuration of the protuberances would remain the same, although their dimensions would be prolonged until they reach the desired height to form the pillow.

Lastly, the unit as a single body corresponding to the system could be complemented with one or several layers superimposed on the same for purposes of comfort. These layers could be reduced in certain areas by means of grooves or holes which would enable better stretching of the different areas of the pressure receiving body.

DESCRIPTION OF THE DIAGRAMS

To complement the description which follows, and to aid understanding of the characteristics of the invention, in accordance with some preferred examples of its practical application, a set of illustrative but not restrictive diagrams are included as an integral part of this description:

FIG. 1.—Shows a cross-section of a portion of the directable cushioning system that is the object of the invention.

FIG. 2.—Shows a practical application of the cushioning system object of this invention to a mattress, on which a person is shown lying with their head resting on a pillow that also has the cushioning system described in this invention.

FIG. 3.—Shows the cushioning system as applied to a seat.

FIG. 4.—Shows the cushioning system as applied to the sole of a shoe.

FIG. 5.—Shows the cushioning system as applied to a wheel.

FIG. 6.—Shows a cross-section detail of a portion of the directable cushioning system including air chambers.

FIG. 7.—Shows a cross-section detail of the directable cushioning system on which the protuberances on one of the parts have a small split in them to favour the rotation and recuperation, and the corresponding grooves in the protuberances on the complementary part of the system can also be observed.

FIG. 8.—Shows a side view detail of the directable cushioning system with the improvements object of the invention applied to one part of a mattress, a conventional mattress system being used in the other part thereof.

FIG. 9.—Shows the directable cushioning system described in the invention complemented by a comfort layer on the upper part, reduced by means of grooves or lines of holes to enhance stretching of the material.

FIG. 10.—Shows a cross-section detail of the directable cushioning system applied to a complete mattress, with two different densities plus the comfort layer, using different types of protuberances for the different areas of body weight.

FIG. 11.—Shows a distribution plan of another application of the system, consisting of a conventional mattress to which a directable cushioning system is coupled or inserted as a "kit".

FIG. 12.—Shows the inclusion of a third material, flexible but with sufficient rigidity between the parts, to provide the system with greater firmness.

FIG. 13.—This last figure shows a view of a denser lower body, as part of the bodies making up a mattress. This view shows the arrangement of the protuberances inclined in opposite directions and with a number of longitudinal cuts.

PREFERRED EMBODIMENT OF THE INVENTION

In accordance with the figures described, it can be observed that the cushioning system, in one form of preferred embodiment, consists of two parts (1 and 1'), each of which is provided with a generally planar side, which may be bent or curved in certain embodiments, and an opposed side with a series of tilted protuberances (2 and 2'), relating to each other alternately so that these parts (1 and 1') make up one single body with parts that are always of different densities.

It should be stressed that the inclination of the series of protuberances (2 and 2') may be variable, with a tilt of 45° being considered optimum, although other inclinations would also be possible, depending on the desired objective. As may be observed in FIGS. 2, 3, 4 and 8, when a pressure or impact is applied to one of the generally planar surfaces of the cushioning system, and the opposite generally planar surface is rigidly supported, the resulting forces cause the inclined protuberances to bend to increase their inclination.

As regards the shape, density and rigidity of each of the parts (1 and 1') and of course their tilted protuberances (2 and 2'), they could be combined according to the particular requirements, so that in the case of impact cushioning the functioning and reactions would be similar, but materials of a greater density would normally be used. In this way, systems of differing rigidities would be obtained, by combining the geometry and density of each of the parts or bodies making up the cushioning itself.

The cushioning system, as has been explained, may have different applications.

So, FIG. 2 shows the cushioning system applied to a mattress with the parts (1 and 1') on which the protuberances (2 and 2') are interrelated correlatively, as described above. It can be observed how the body (3) of a person lying on the body of the mattress using the said cushioning system has two sections (A-B), in each of which the series of protuberances (2 and 2') have a different inclination, i.e. an opposing orientation in these areas or sections (A-B), with forces as indicated by the arrows acting on these opposing orientations, thus enabling body stretching for the person (3) and greater relaxation for the back, as the person benefits from gentle traction while resting. It can thus be seen how the person (3)

rests their head on a pillow (4) with the same cushioning system, so that the joint unit (mattress and pillow) favours decompression of the vertebral column and efficiently reduces pressure on vertebra, joints, etc.

In this figure (FIG. 2) showing the application of the cushioning system, part (1) corresponds to the denser area, and part (2) to the less dense area.

In the practical application of the system to a seat (5), as shown in FIG. 3, a person (3) is shown sitting on the armchair (5), which provides several beneficial effects, with the person (3) adapting better to the backrest of the seat (5), as on resting their back on the backrest an effect of upward thrust is obtained, as shown by the upward arrows inside the seat backrest (5), making their posture more ergonomic and relaxing, with less stress to the back, so that the person (3) adapts better to the seat backrest due to the cushioning effects provided by the protuberances (2 and 2') as a result of the upward thrust generating a "massage" effect, as indicated by the arrows above the seat. Its use in car seats and headrests could also be beneficial, mitigating the acting forces of a rear impact by deflection.

Figure 1:
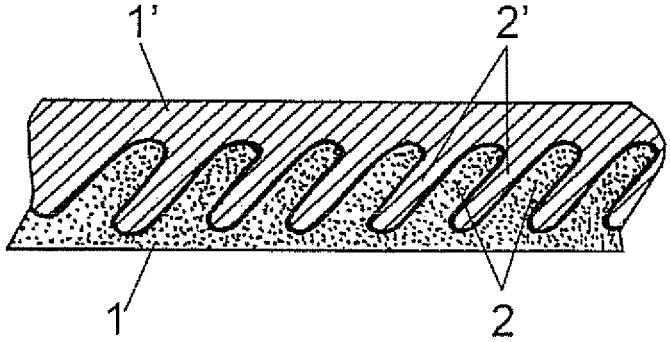
Figure 2:
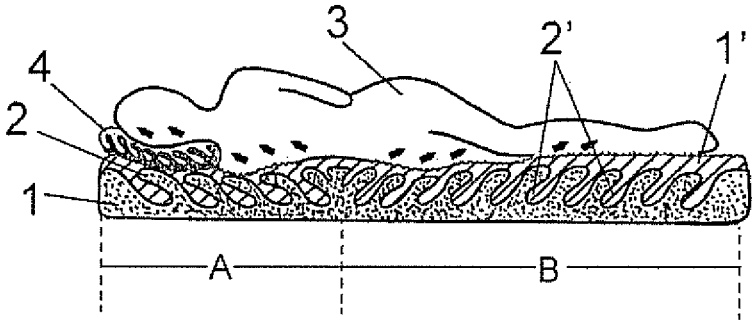
Figure 3:
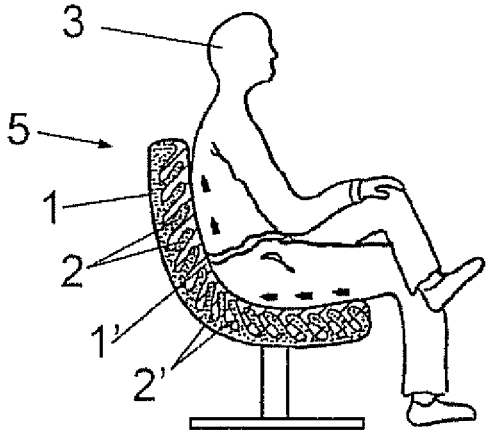
Figure 4:
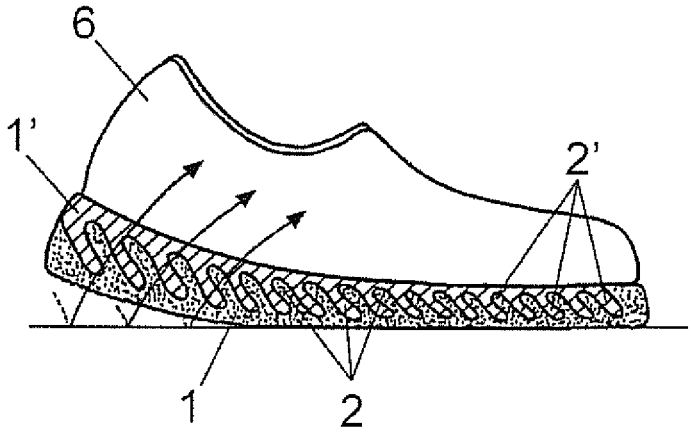
FIG. 4 shows the application of the cushioning system to a shoe (6). In this case greater cushioning is obtained in comparison with conventional footwear, together with a greater impulse due to the spring effect provided by the tilted protuberances (2 and 2'), which favours the direction of travel, as shown by the V-shaped arrows on the lower part of the heel.
Figure 5:
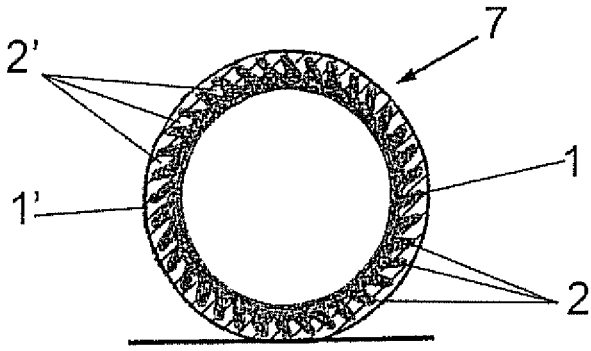
FIG. 5 shows the system applied to a wheel (7). The inclination of the protuberances (2 and 2'), compressed when the wheel makes contact with the ground, favours rotation of the wheel (7) in the direction of travel.
Figure 6:
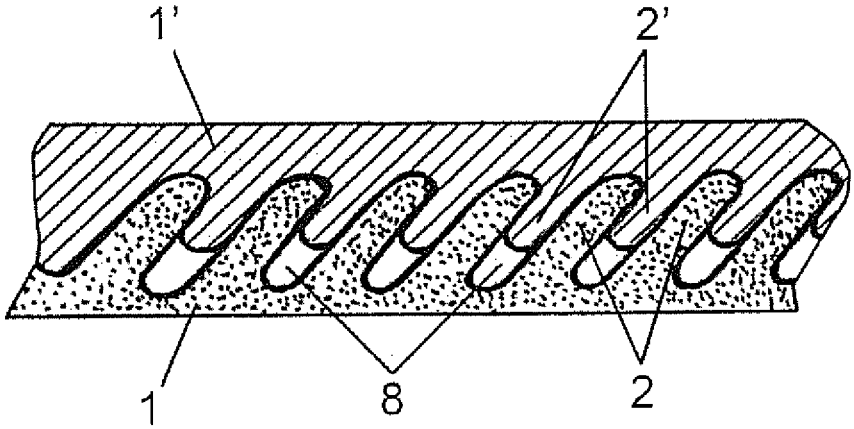

FIG. 6 shows a variant of FIG. 1, in which in part (1) a succession of tilted protuberances (2) are provided on one of the faces, complementing another series of tilted protuberances (2') provided on the part or body (1'), so that both protuberances (2 and 2') may be coupled together to form one single body, with the special feature that the protuberances (2') of the less dense body (1') are shorter than protuberances (2), so that air chambers (8) are created when coupling occurs, as the ends of protuberances (2') do not reach the bottom of the grooves given rise to between protuberances (2) of the denser body (1), and this leads to the formation of the air chambers (8) that can be clearly seen in the figure.

Evidently, the cushioning system obtained with the air chamber arrangement could be applicable to mattresses, seats, shoe soles and insoles, wheels and other components; the inclinations of the protuberances (2 and/or 2') on the same body or part may be different, in order to obtain a different degree of cushioning strength, and some protuberances could also be of a different configuration and a different thickness from others.

In accordance with the above, the single body obtained by combining and coupling the parts or bodies (1 and 1') of different densities, in virtue of the different lengths of the protuberances (2 and 2') of these parts or bodies (1 and 1'), the air chambers (8) created provide a series of advantages which have already been described, such as improved ventilation, greater lightness, cheaper production, easier transportation due their lesser weight and better regulation of the rigidity of the single body obtained, as in all cases the air chambers (8) could have a greater or lesser depth depending on the length of protuberances (2') on the less dense body or part (1').

Figure 7:
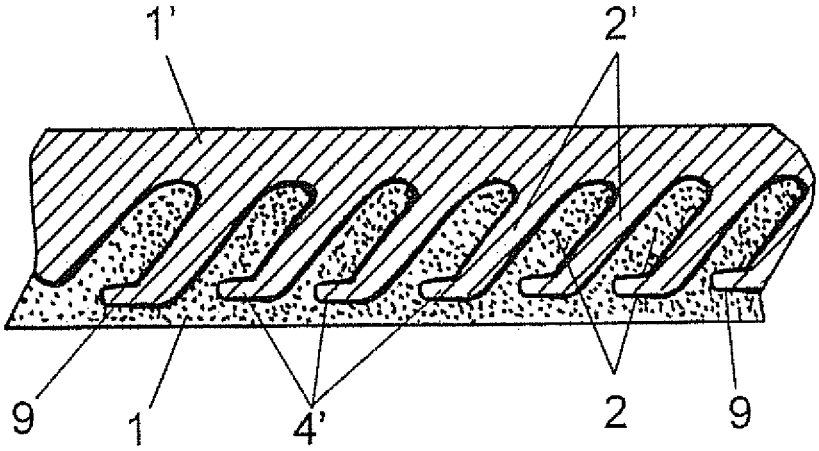

As can be seen in FIG. 7, protuberances (2) on one of the bodies or parts, more specifically that of body (1), may have a groove (9) made in them to favour the movement made by both protuberances (2') and protuberances (2), when pressure is exerted by the body of a person lying on a mattress using the cushioning system referred to, for example, with grooves containing the respective split prolongations that could form part of protuberances (2') of the other part or body (1').

Figure 8:
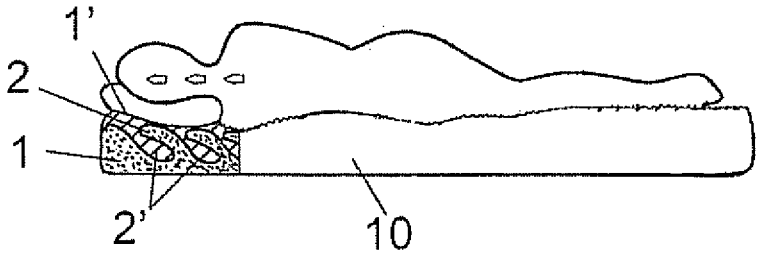

In the example shown in FIG. 8, for the specific case of a mattress, the cushioning system described in the invention could be embodied in part, but not all, of a conventional mattress, as in the example shown, i.e. the section on which the user's head would rest, while the rest of the mattress, in this case, with reference (10) it would be embodied in a conventional mattress, although logically this part of the cushioning system could be inserted in an intermediate area of the mattress, e.g. the part supporting the lumbar region, instead of the part supporting the head as shown in this figure.

Figure 9:
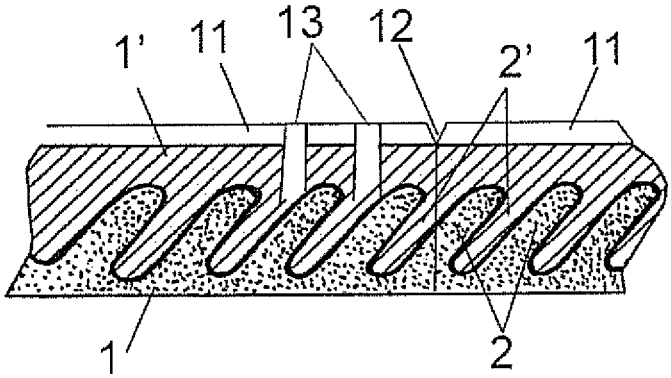

The cushioning system referred to could also be complemented by a comfort layer (11). This comfort layer (11) could cover the entire body-supporting area, or it could be reduced by means of grooves (12) or holes (13) in order to favour stretching as shown in FIG. 9. This comfort layer (11) could also be made up of two separate parts. By "breaking" the linearity of the comfort layers, the receiving body or bodies located beneath the same could behave differently, thus adjusting better to the greater or lesser pressure being exerted (by the weight of the person, in this case).

Figure 10:
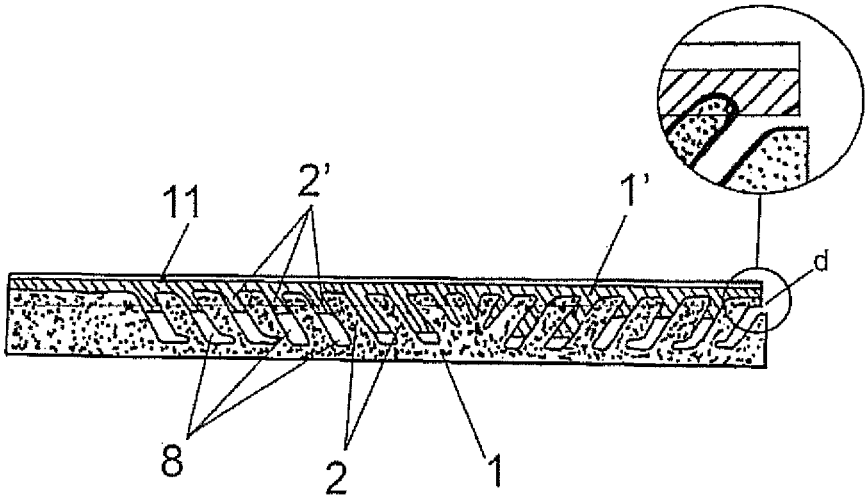

FIG. 10 shows a longitudinal section of a mattress using the directable cushioning system described in the invention, with two different densities and with a comfort layer (11), and it also shows different types of protuberances, some thicker than others, some with split prolongations, some with different inclinations, some continuous, for feet, etc., according to the different areas of the mattress needing to withstand different weights. This figure also shows the dimension ("d") corresponding to the longitudinal space which would facilitate displacement of the upper surface of the mattress, preventing it from hitting the headboard.

Figure 11:
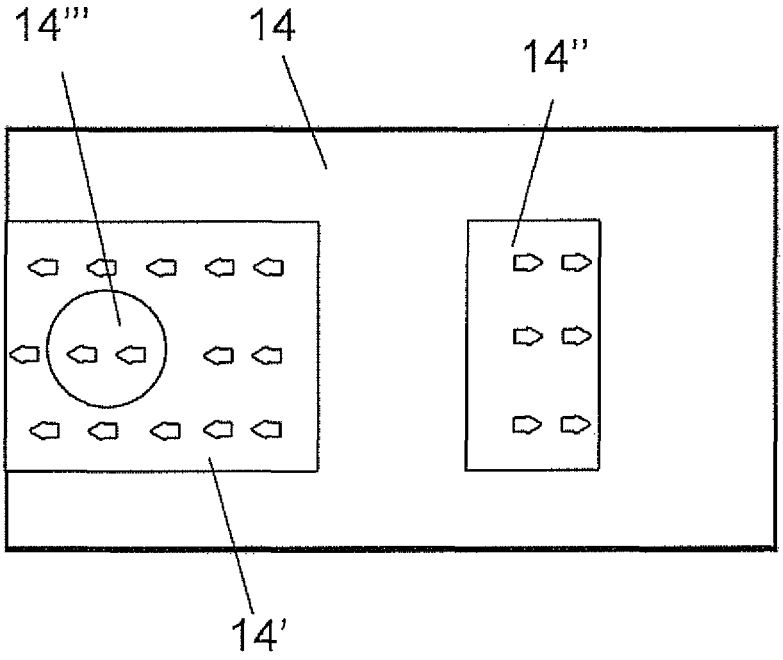

FIG. 11 shows a ground plan of a mattress (14), representing another form of application of the system described in the invention, that of a kit, i.e. where blocks or kits using the directable cushioning system described in the invention could be used in certain areas of the mattress. The example in the figure shows the area for the back (14'), the area for the lumbar region (14") and the circular area (14'") for the head.

Figure 12:
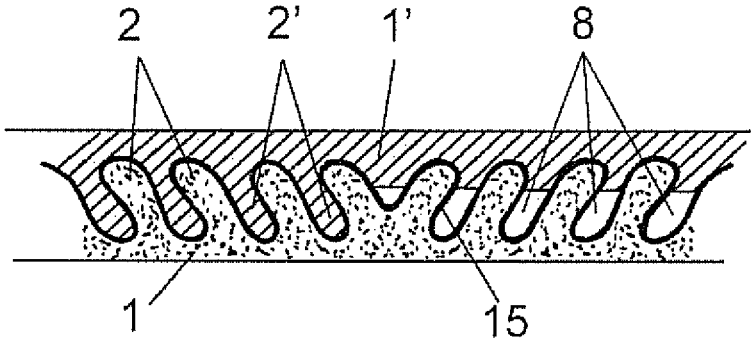

FIG. 12 shows another application of the system with the parts or bodies (1 and 1'), their protuberances (2 and 2'), the air chambers (8) and also a third part or body (15) incorporated to the two parts or bodies (1 and 1'), made of flexible material but sufficiently rigid, and which would provide the system with greater firmness or rigidity.

Figure 13:
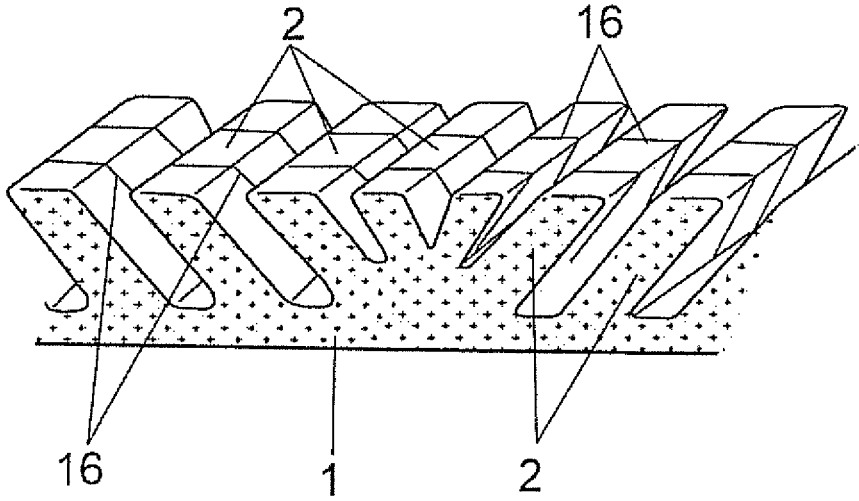

Lastly, FIG. 13, representing the lower body or part (1), of greater density, of a mattress using the system, shows the different inclination of the protuberances (2) and several longitudinal cuts (16) made to the same, for better regulation of the firmness or rigidity of certain areas of the mattress.

The invention claimed is:

1. A mattress comprising a directable cushioning system comprising two pressure or impact receiving bodies complementing each other (1 and 1'), each comprising a generally planar surface on one side and a series of protuberances (2 and 2') on the side opposed, with the two bodies (1 and 1') being of an elastic nature and of different densities, characterised by the less denser (1') of the two bodies being shorter than the denser body (1) in the elongated direction of the planar surfaces and being supported on the top of the denser body with the two bodies (1 and 1') being joined by means of their protuberances (2 and 2'), which are inclined with respect to their generally planar surfaces and each of the pressure receiving bodies comprising a first group of the protuberances inclined with respect to their generally planar surfaces in a first direction and a second group of the protuberances inclined with respect to their generally planar surfaces in a second direction opposite to the first direction; with the two bodies being assembled by means of their protuberances (2 and 2') inserted between each other whereby, upon the provision of pressure or impact on the generally planar surface of one of the bodies, the resultant forces cause the tilted protuberances to bend and the shorter, less dense body (1') to move in an elongated direction relative to the longer, denser lower body (1) due to the bending of the tilted protuberances under forces applied between the planar surfaces of the two bodies (1 and 1').

2. A mattress comprising a directable cushioning system according to claim 1, characterised by the fact that the protuberances (2') of the less dense body (1') are shorter than the protuberances (2) corresponding to the denser body (1), with the coupling between the corresponding protuberances (2 and 2') being determined by air chambers (8) of a variable capacity, according to the difference in length between the protuberances (2 and 2').

3. A mattress comprising a directable cushioning system, according to claim 1, characterised by the fact that a third part (15) is also included between the two bodies (1 and 1'), such third body being made of a flexible material.

4. A mattress comprising a directable cushioning system, according to claim 1, characterised by the fact that it includes a number of longitudinal cuts (16) made on the protuberances (2) of the denser lower body (1) of the system's components.

5. A mattress comprising a directable cushioning system, according to claim 1, characterised by the fact that the protuberances (2 and 2') of one or both of the two parts (1 and 1') include a groove (9) combined with a small split at the end of the complementary protuberances.

6. A mattress comprising a directable cushioning system, according to claim 1, characterised by the fact that a comfort layer (11) is added to the single unit made up of the bodies (1 and 1') assembled by means of their protuberances (2 and 2'), either as a single body or made up of separate elements with a physical separation between the layers; and grooves (12) and/or holes (13) are formed in this comfort layer.

7. The mattress of claim 1, wherein at least one of said pressure or impact receiving bodies has different shapes or thicknesses at different areas along its axis of elongation.

8. The mattress of claim 1, wherein the protuberances are disposed in limited areas (14', 14", 14'") of the two pressure or impact receiving bodies (14).

* * * * *